US010442446B2

(12) United States Patent
Anderson et al.

(10) Patent No.: US 10,442,446 B2
(45) Date of Patent: Oct. 15, 2019

(54) AUTO-RACK RAILROAD CAR BRIDGE PLATE AND BRIDGE PLATE LOCKING ASSEMBLY

(71) Applicant: Standard Car Truck Company, Rosemont, IL (US)

(72) Inventors: John D. Anderson, Oswego, IL (US); Walter J. Peach, Montgomery, IL (US); Edward L. Vechiola, Lombard, IL (US)

(73) Assignee: Standart Car Truck Company, Rosemont, IL (US)

( * ) Notice: Subject to any disclaimer, the term of this patent is extended or adjusted under 35 U.S.C. 154(b) by 260 days.

(21) Appl. No.: 15/462,119

(22) Filed: Mar. 17, 2017

(65) Prior Publication Data

US 2017/0334463 A1 Nov. 23, 2017

Related U.S. Application Data

(60) Provisional application No. 62/339,354, filed on May 20, 2016.

(51) Int. Cl.
*B61D 3/18* (2006.01)

(52) U.S. Cl.
CPC ..... *B61D 3/187* (2013.01)

(58) Field of Classification Search
CPC ... B61D 3/00; B61D 3/02; B61D 3/04; B61D 3/16; B61D 3/18; B61D 3/187
See application file for complete search history.

(56) References Cited

U.S. PATENT DOCUMENTS

| | | | |
|---|---|---|---|
| 951,518 | A | 3/1910 | Welch et al. |
| 1,040,529 | A | 10/1912 | Douglas |
| 1,160,587 | A | 11/1915 | Fallon |
| 1,851,539 | A | 3/1932 | Fitch et al. |
| 2,788,751 | A | 4/1957 | Russell |
| 3,001,266 | A | 9/1961 | Kilbane et al. |
| 3,003,167 | A | 10/1961 | Smith |
| 3,004,500 | A | 10/1961 | Johnson |
| 3,094,946 | A | 6/1963 | Bain et al. |
| 3,161,153 | A | 12/1964 | Johnson |
| 3,195,478 | A | 7/1965 | Thompson |

(Continued)

OTHER PUBLICATIONS

US 6,435,104 B1, 08/2002, Forbes (withdrawn)

(Continued)

*Primary Examiner* — Robert J McCarry, Jr.
(74) *Attorney, Agent, or Firm* — Neal, Gerber & Eisenberg LLP

(57) ABSTRACT

The present disclosure provides an auto-rack bridge plate locking assembly including a support bracket, a support block, a guide tube, a slidable locking pin partially positioned in the guide tube, a handle removably attachable to the locking pin by a removable roll pin, a fixed pivot pin partially positioned in the guide tube, and a spring positioned in the guide tube between the pivot pin and the locking pin. The present disclosure also provides an auto-rack railroad car bridge plate including a plate configured to extend from one auto-rack railroad car to an adjacent auto-rack railroad car, and such locking assembly connected to the plate and configured to pivotally attach the plate to one of the auto-rack rail road cars.

34 Claims, 14 Drawing Sheets

(56) References Cited

U.S. PATENT DOCUMENTS

| | | | |
|---|---|---|---|
| 3,203,364 | A | 8/1965 | Gutridge |
| 3,216,372 | A | 11/1965 | Boone |
| 3,216,373 | A | 11/1965 | Boone |
| 3,228,355 | A | 1/1966 | Black |
| 3,257,972 | A | 6/1966 | Boone et al. |
| 3,323,472 | A | 6/1967 | Boone et al. |
| 3,327,650 | A | 6/1967 | Bridges et al. |
| 3,351,024 | A | 11/1967 | Broling |
| 3,421,454 | A | 1/1969 | Connerat |
| 3,521,576 | A | 7/1970 | Murray |
| 3,521,577 | A | 7/1970 | Akers |
| 3,556,020 | A | 1/1971 | Akers |
| 3,572,254 | A | 3/1971 | Slager |
| 4,191,107 | A | 3/1980 | Ferris et al. |
| 4,667,604 | A | 5/1987 | Baker |
| 4,677,918 | A | 7/1987 | Baker et al. |
| 4,686,909 | A | 8/1987 | Burleson |
| 4,721,426 | A | 1/1988 | Bell et al. |
| 5,515,792 | A | 5/1996 | Bullock et al. |
| 5,535,681 | A | 7/1996 | Sarnicki et al. |
| 5,575,222 | A | 11/1996 | Sauer et al. |
| 5,596,936 | A | 1/1997 | Bullock et al. |
| 5,657,698 | A | 8/1997 | Black, Jr. et al. |
| 5,782,187 | A | 7/1998 | Black, Jr. et al. |
| 5,845,584 | A | 12/1998 | Bullock et al. |
| 6,539,878 | B1 | 4/2003 | Coslovi et al. |
| 6,550,399 | B1 | 4/2003 | Coslovi et al. |
| 6,550,400 | B1 | 4/2003 | Forbes |
| 6,857,376 | B2 | 2/2005 | Coslovi et al. |
| 7,255,047 | B1 | 8/2007 | Coslovi et al. |
| 2006/0102045 | A1 | 5/2006 | Larsen et al. |
| 2007/0022899 | A1 | 2/2007 | Burt et al. |
| 2009/0304481 | A1* | 12/2009 | Larsen ..... B61D 3/187 414/340 |

OTHER PUBLICATIONS

Pictures of bridge plate locking assemblies, (Available Prior to May 20, 2016) (8 pages).

Michigan Scientific Transportation Products, LLC, Pictures of Bridge Plate Hinge, (Available Prior to May 20, 2016) (15 pages).

* cited by examiner

AUTO-RACK RAILROAD CAR BRIDGE PLATE AND BRIDGE PLATE LOCKING ASSEMBLY

PRIORITY CLAIM

This application claims priority to and the benefit of U.S. Provisional Patent Application No. 62/339,354, filed May 20, 2016, the entire contents of which are incorporated herein by reference.

BACKGROUND

The railroad industry employs a variety of auto-rack railroad cars for transporting newly-manufactured vehicles such as automobiles, vans, and trucks. Auto-rack railroad cars, known in the railroad industry as auto-rack cars, often travel thousands of miles through varying terrain. Auto-rack cars can have one deck, and often are compartmented, having two or three decks. Newly manufactured vehicles are loaded into and unloaded from an auto-rack car for transport by one or more persons (each sometimes called a "loader") who drive the vehicles into or out of the auto-rack car.

One problem relating to auto-rack cars involves the bridge plates used to load and unload a string or series of connected or coupled auto-rack cars. Prior to loading or unloading the string or series of connected or coupled auto-rack cars, the doors of the auto-rack cars are opened and bridge plates are positioned in the gaps between each of the adjacent auto-rack cars. In other words, each gap between each pair of adjacent decks of adjacent auto-rack cars is spanned by a pair of portable removable bridge plates to load the vehicles. The vehicles are loaded in the auto-rack cars by driving the vehicles into one end of the string or series of connected or coupled auto-rack cars, over the bridge plates and through the adjacent cars until all of the auto-rack cars in the series or string are filled. The vehicles are driven into the first auto-rack car on either the first, second, or third deck (depending upon the type and size of auto-rack car and the vehicle). One deck or level at a time is typically loaded, and then the bridge plates are moved downwardly or upwardly to load the next deck or level. This process is reversed for unloading the vehicles from the string or series of connected or coupled auto-rack cars.

Each pair of bridge plates supports the vehicle as it is driven over the gap between the aligned decks of the adjacent auto-rack cars with one bridge plate supporting the right side and the other bridge plate supporting the left side of the vehicle. The bridge plates are typically mounted to the auto-rack cars only during the loading and unloading of the vehicles. The Association of American Railroads (AAR) specifies a maximum weight, a minimum strength requirement, and a fatigue load for such bridge plates in AAR Specifications.

Each bridge plate is typically made of an aluminum plate and a steel locking assembly attached to the bottom of one end of the aluminum plate. Each bridge plate is pivotally attached by the locking assembly to one end of one auto-rack car and spans the gap to the deck of the adjacent auto-rack car. Each bridge plate is only attached to one of the adjacent auto-rack cars at one end so as to accommodate variable spacing between adjacent coupled auto-rack cars in the string or series of auto-rack cars that are undergoing loading or unloading. The end of the bridge plate that is the non-pivotally attached end of the bridge plate rests on the adjacent auto-rack car deck. The steel locking assembly of each bridge plate includes multiple outwardly extending pins (including a spring biased locking pin) that pivotally attach the bridge plate to one of the auto-rack cars. The locking assembly is connected to and can be accessed from the bottom side of the bridge plate.

One such known bridge plate locking assembly includes: (a) a support bracket; (b) a guide tube connected to the bottom of the support bracket; (c) a first slidable locking pin partially positioned in the guide tube; (d) a first handle integrally attached to the first slidable locking pin; (e) a second slidable locking pin positioned in the guide tube; (f) a second handle integrally attached to the second slidable locking pin and also integrally connected to first handle; (g) a pivot pin partially positioned in the guide tube and loosely attached to the guide tube by a rivet; (h) a collar journaled about to the second locking pin; and (i) a spring positioned in the guide tube between the collar and the pivot pin.

During use, installation, and/or removal of bridge plates that have such locking assemblies, the bridge plates and the locking assemblies thereof are often subjected to various forces (such as forces that occur when such bridge plates are dropped). When a bridge plate is subjected to such forces, one or more components of the locking assembly of that bridge plate can be bent, cracked, or otherwise damaged. For example, in the known locking assembly described above, one or more of: (i) the guide tube; (ii) the first slidable locking pin; (iii) the second slidable locking pin; and (v) the pivot pin, often become bent or otherwise damaged. When this occurs, the locking assembly does not easily function, does not properly function, or does not function at all. In another example, the collar journaled about the second slidable locking pin can crack and then move with respect to the second slidable locking pin. When this occurs, the tension provided by the spring on the first and second locking pins is reduced and this know locking assembly does not easily function, does not properly function, or does not function at all.

This known locking assembly cannot be easily, quickly, or efficiently repaired because the first locking pin, the second locking pin, and the respective handles are welded to each other and thus cannot be readily removed from the guide tube. Thus, the entire locking assembly must be replaced or the entire bridge plate must be replaced.

Accordingly, there is a need to solve these problems.

SUMMARY

Various embodiments of the present disclosure provide an auto-rack railroad car bridge plate locking assembly that solves the above problems by providing a locking pin that is easily and readily replaceable, by providing a guide tube that is less likely to bend, and by providing a more secure or fixed pivot pin.

Various embodiments of the present disclosure provide an auto-rack railroad car bridge plate locking assembly including: (a) a support bracket configured to be connected to an auto-rack railroad car bridge plate; (b) a guide tube connected to the bottom of the support bracket; (c) a support block positioned between and connected to the bottom of the support bracket and to the top of the guide tube; (d) a single slidable locking pin partially positioned in one end of the guide tube and partially extending from that end of the guide tube; (e) a handle extending transversely from and removably attached to the locking pin by a removable fastener such as a roll pin; (f) a fixed pivot pin partially positioned in the opposite end of the guide tube, securely or fixedly connected to that opposite end of the guide tube, and partially extending from that end of the guide tube; and (g) a spring positioned in the guide tube between and abutting each of the fixed pivot pin and the slidable locking pin. The support block prevents or inhibits the likelihood that the guide tube will bend relative to the support bracket. The removable handle and locking pin enable the locking pin to be replaced if the locking pin is bent during use, installation, or removal. The configuration and securement of the fixed pivot pin to the guide tube reduces the likelihood that the pivot pin will be bent. The combination of these components decreases the likelihood that the locking assembly of the present disclosure will not easily function, not properly function, or not function at all. The combination of these components also enables the locking assembly of the present disclosure to be readily and efficiently repaired without the need to replace the entire locking assembly or the entire bridge plate.

Various embodiments of the present disclosure also provide an auto-rack railroad car bridge plate having the locking assembly described herein.

Other objects, features and advantages of the present invention will be apparent from the following detailed disclosure, taken in conjunction with the accompanying sheets of drawings, wherein like reference numerals refer to like parts.

DETAILED DESCRIPTION

Figure 1:
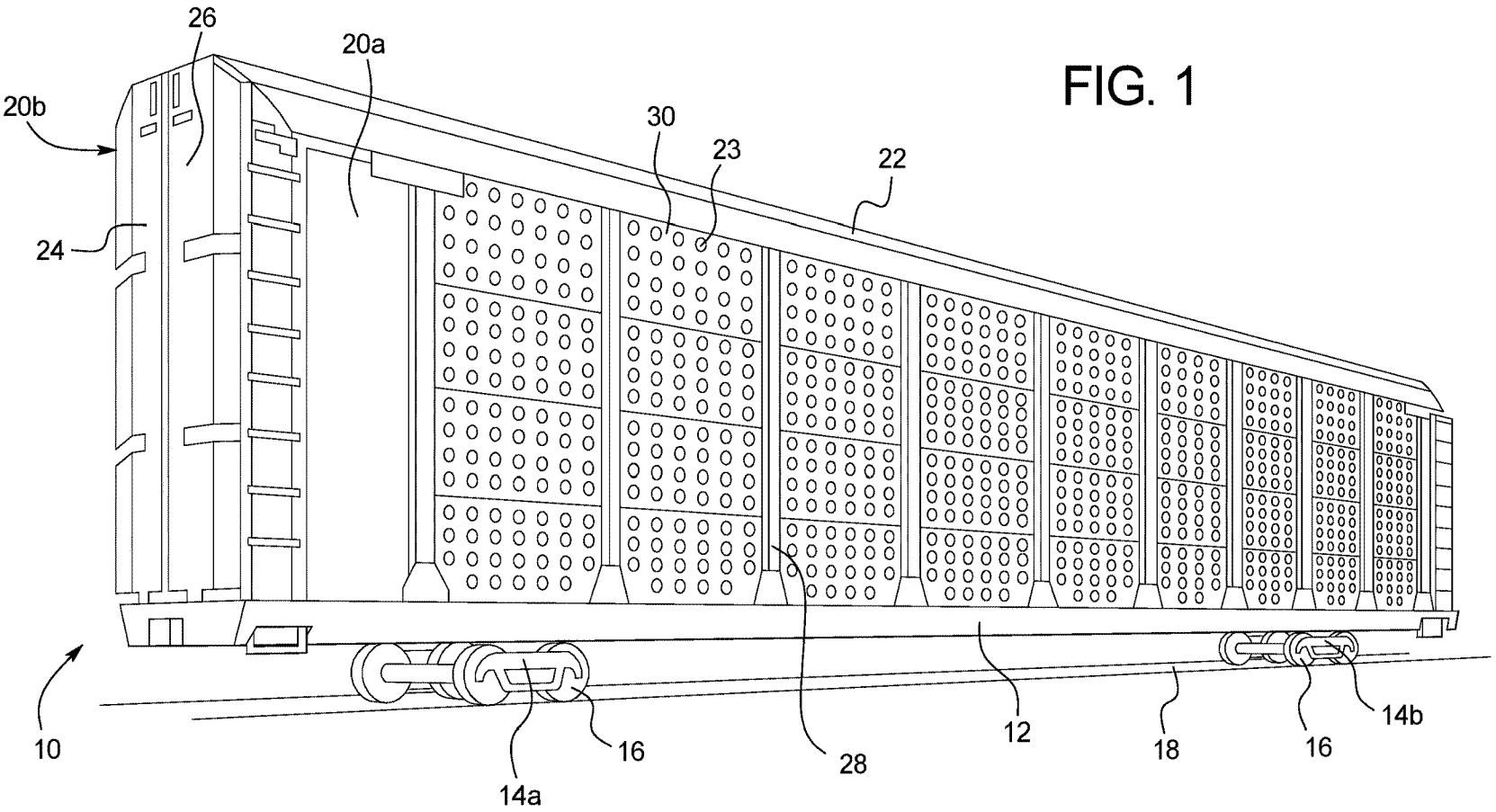
FIG. 1 is a side perspective view of an auto-rack railroad car configured to transport a plurality of vehicles.

Referring now to the drawings and particularly to FIG. 1, a typical auto-rack car 10 includes a frame 12 supported by trucks 14*a* and 14*b*, each of which has several wheels 16 configured to roll along conventional railroad tracks 18. The frame 12 supports two opposing sidewalls 20*a* and 20*b* and a roof 22. The auto-rack car 10 includes a pair of co-acting clamshell doors 24 and 26 mounted on each end of the auto-rack car 10. The doors 24 and 26 are opened to facilitate the loading and unloading of vehicles into and out of the auto-rack car 10 and are closed during transport or storage of the vehicles. It should be appreciated that the present disclosure can be employed on such auto-rack cars or otherwise configured auto-rack cars.

The sidewalls 20 include a series of steel vertical posts 28 that are mounted on and extend upwardly from the frame 12. The roof 22 is mounted on and supported by these vertical posts. The vertical posts are evenly spaced along the entire length of both sidewalls 20 of the auto-rack car 10. A plurality of rectangular galvanized steel side wall panels 30 that extend horizontally and are vertically spaced apart are mounted between each pair of vertical posts 28. These side wall panels are supported at their corners by brackets (not shown) that are suitably secured to the vertical posts. The average side wall panel has a multiplicity of round sidewall panel holes 23. These side wall panel holes 23 provide the auto-rack car with natural light as well as proper ventilation. Proper ventilation prevents harm from the toxic vehicle fumes to the person or persons (i.e., loaders) loading or unloading the vehicles into or out of the auto-rack car.

Figure 2A:
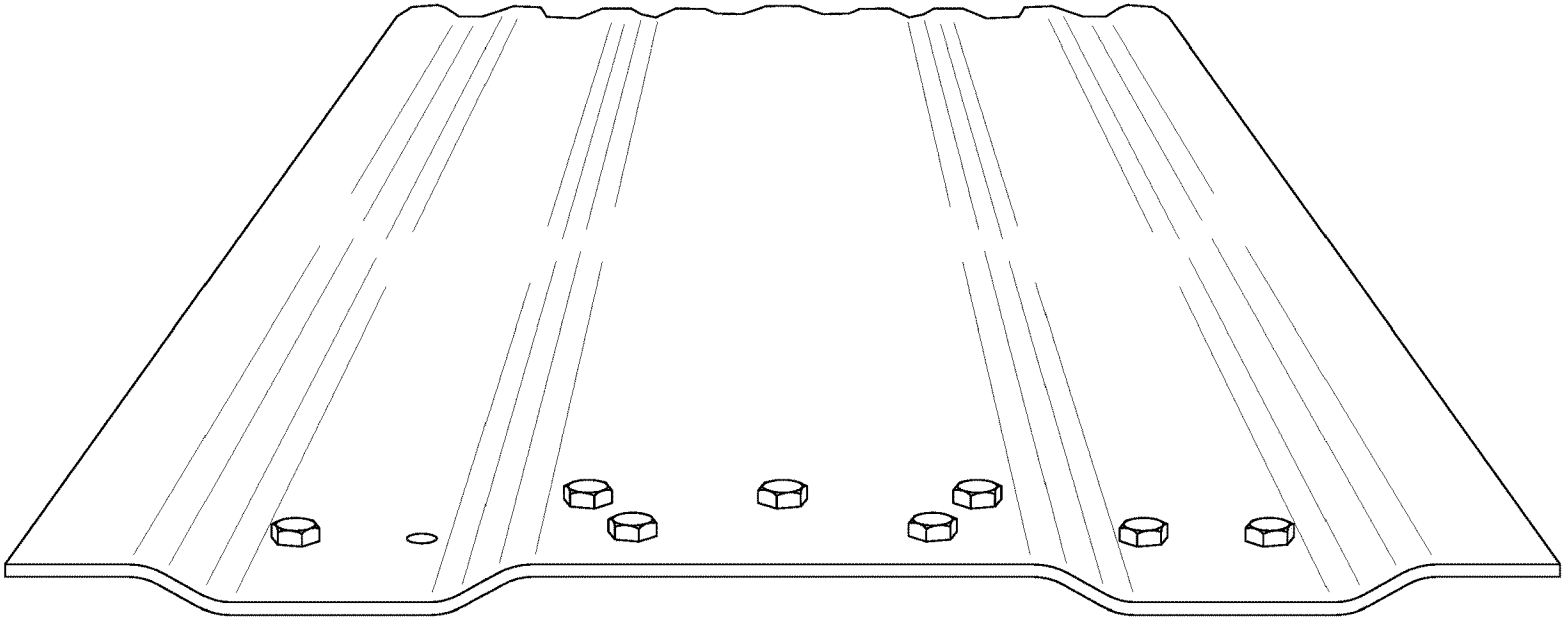
FIG. 2A is a top perspective view of an auto-rack railroad car bridge plate with the auto-rack railroad car bridge plate locking assembly of one example embodiment of the present disclosure attached thereto.
Figure 2B:
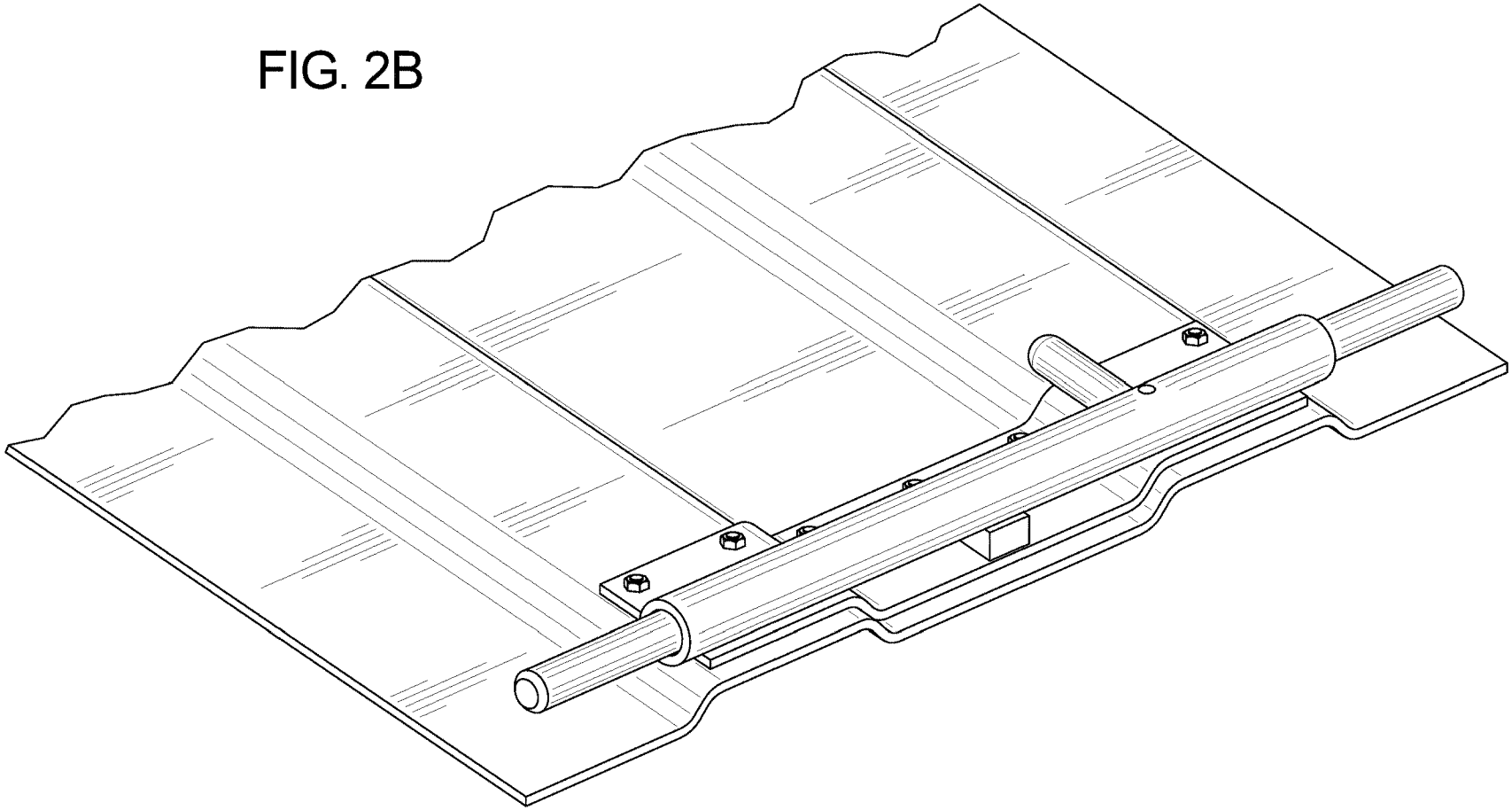
FIG. 2B is a bottom perspective view of the auto-rack railroad car bridge plate of FIG. 2A with the auto-rack railroad car bridge plate locking assembly of FIG. 2A attached thereto.
Figure 3A:
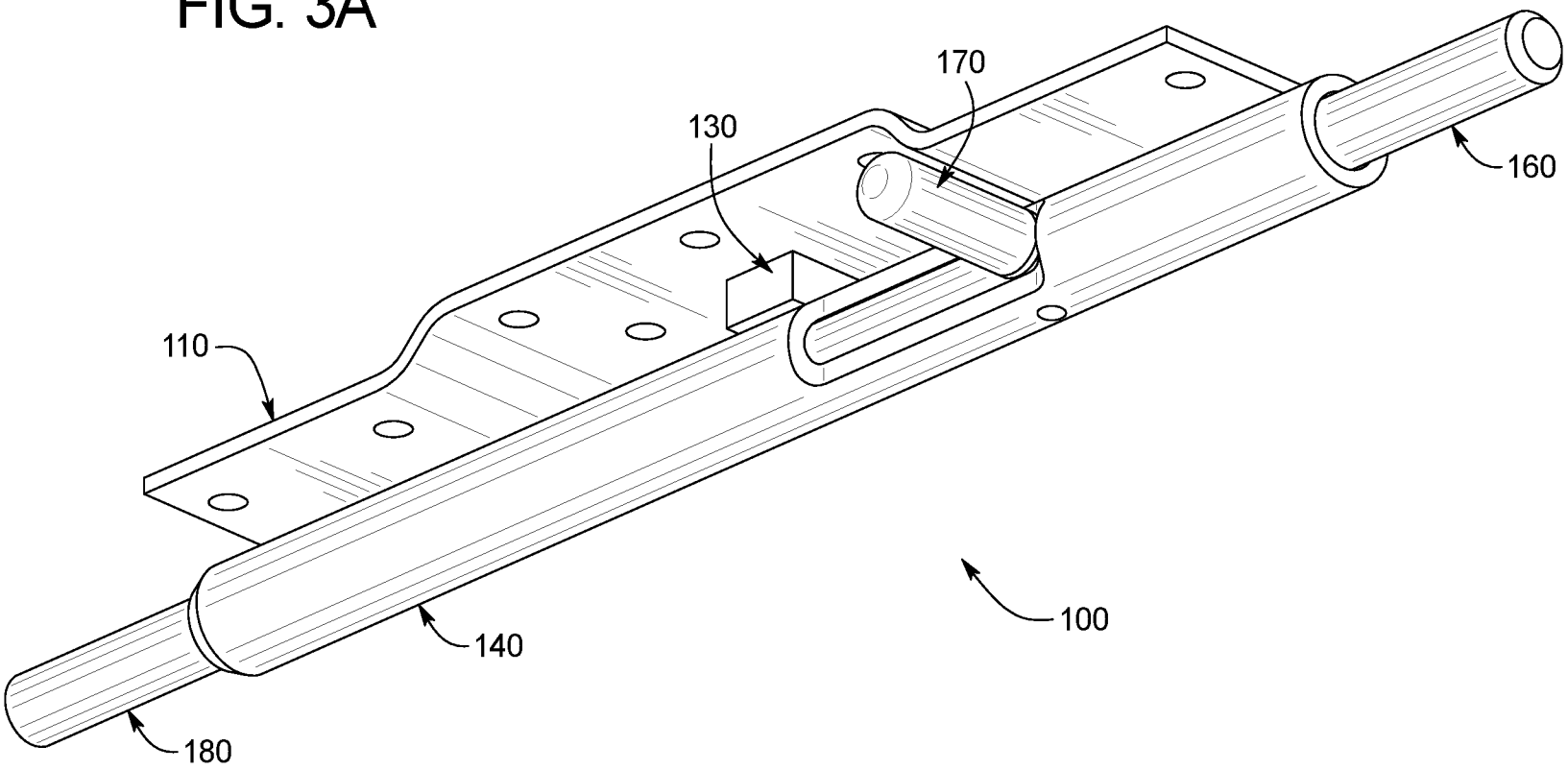
FIG. 3A is a bottom front perspective view of the auto-rack railroad car bridge plate locking assembly of FIGS. 2A and 2B.
Figure 3B:
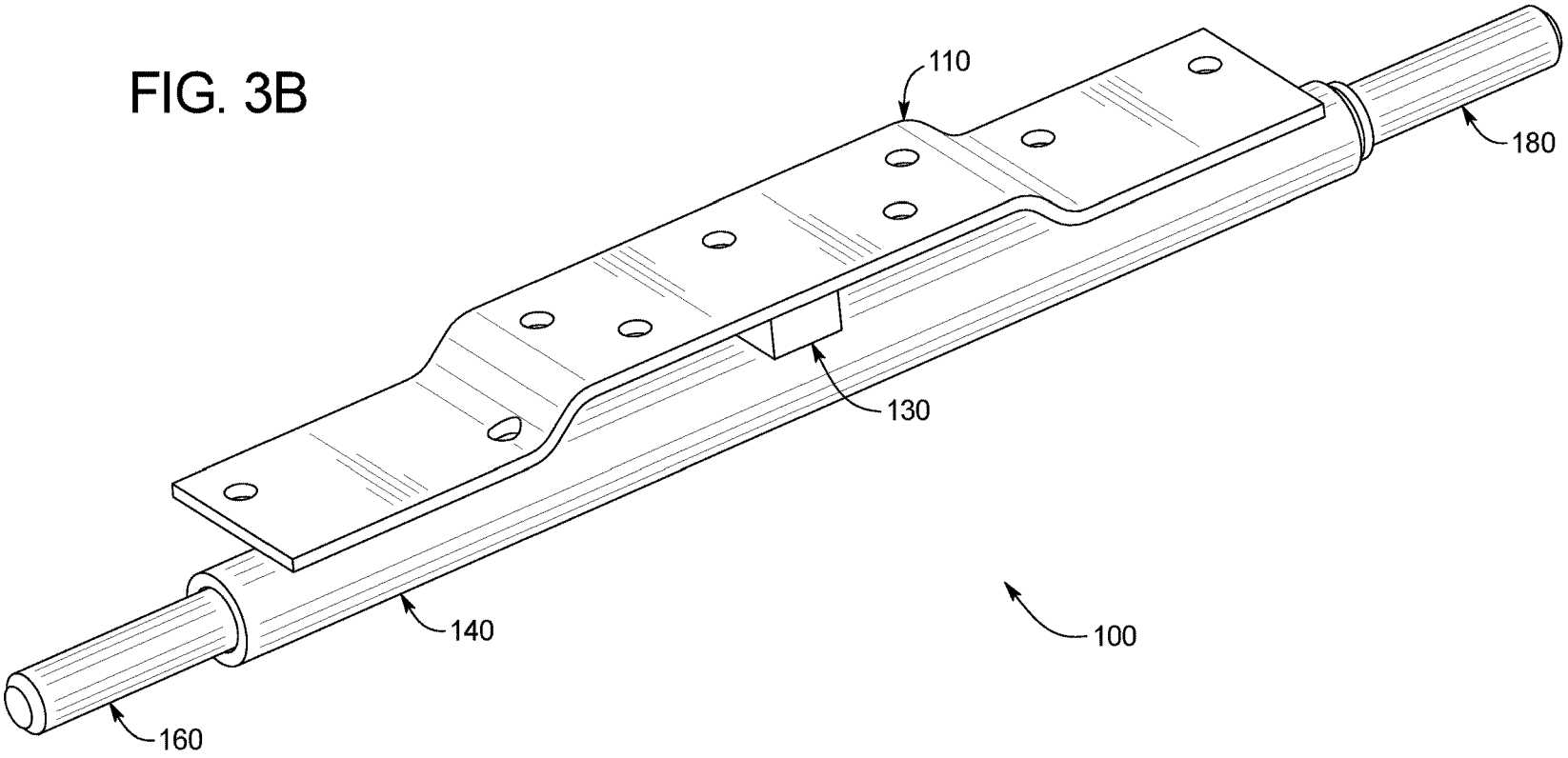
FIG. 3B is a rear top perspective view of the auto-rack railroad car bridge plate locking assembly of FIG. 3A.

Referring now to FIGS. 2A, 2B, 3A, 3B, 4, 5, 6, 7, 8, 9, 10, 11, and 12, the bridge plate locking assembly of one example embodiment of the present disclosure is generally illustrated and indicated by numeral 100. The bridge plate locking assembly 100 of the present disclosure is particularly configured for auto-rack cars (that have one or more levels or decks) such as auto-rack car 10. The auto-rack railroad car bridge plate locking assembly of the present disclosure is sometimes referred to herein for brevity as the locking assembly; such abbreviation is not meant to limit the present disclosure. FIGS. 2A and 2B generally show the bridge plate locking assembly 100 attached to a bottom of a bridge plate.

The auto-rack railroad bridge plate locking assembly 100 of various embodiments of the present disclosure generally includes a support bracket 110 configured to be attached to an auto-rack railroad car bridge plate, a support block 130 connected to the bottom of the support bracket 110, a guide tube 140 connected to the bottom of the support bracket 110 and connected to the bottom of the support block 130, a slidable locking pin 160 partially positioned in a first end of the guide tube 140 and partially extending from the first end of the guide tube 140, a removable handle 170 removably attached to the locking pin 160 by a removable fastener such as roll pin 168, a fixed pivot pin 180 partially positioned in and securely connected to a second end of the guide tube 140 and partially extending from the second end of the guide tube 140, and a spring 190 positioned in the guide tube 140 between and abutting the fixed pivot pin 180 and the locking pin 160.

In this illustrated embodiment, the support bracket 110, the support block 130, the guide tube 140, the slidable locking pin 160, the removable handle 170, the locking pin 160, the removable roll pin 168, the fixed pivot pin 180, and the spring 190 are all made from suitable metals such as steel. It should be appreciated that one or more of these components of the locking assembly can be made from other suitable materials. It should also be appreciated that one or more of these components can be coated with a protective coating such as paint. It should also be appreciated that one or more of these components can be plated.

More specifically, in this illustrated embodiment, as best seen in FIGS. 3A, 3B, 4, 5, 6, and 7, the support bracket 110 includes an elongated body 111 including five integrally formed or connected sections, and particularly a first section 111*a*, a second section 111*b*, a third section 111*c*, a fourth section 111*d*, and a fifth section 111*e*. The first section 111*a* and the spaced apart fifth section 111*e* lie in the same plane. The third section 111*c* lies in a higher plane. The second section 111*b* is curved and connects the first section 111*a* to the third section 111*c*. Likewise, fourth section 111*d* is curved and connects the fifth section 111*e* to the third section 111*c*. The shapes of these sections generally correspond with the contour of the plate of the bridge plate to facilitate connection of the locking assembly 100 to the plate of the bridge plate. The openings 112*a* in the first section 111*a*, openings 112*b*, 112*c*, 112*d*, 112*e*, and 112*f* of the third section 111*c*, and the openings 112*g* and 112*h* in the fifth section 111*e* are employed for attaching the locking assembly 100 to the bridge plate by suitable fasteners (not shown) such as bolts and nuts (not shown).

The second section 111*b* defines a pin removal opening 115 that enables the roll pin 168 to be removed from the locking pin 160 and the handle 170 as further described below. In other words, the support bracket 110 defines a roll pin removal opening 115 that enables the removal of the roll pin 168 (that securely holds or connects the handle 170 to the locking pin 160) when the locking pin 160 needs to be replaced as further described below.

In this illustrated embodiment, as best seen in FIGS. 3A, 3B, 4, and 5, the support block 130 is positioned between the third section 111*c* of the support bracket 110 and the guide tube 140. In this illustrated embodiment, the support block 130 is connected (by welding) to the top of the guide tube 140 and is also connected (by welding) to the bottom of the support bracket 110; however, it should be appreciated that the support block 130 may alternatively only be connected (such as by welding) to only one of these components in accordance with the present disclosure. The support block 130 prevents or reduces the likelihood that the guide tube 140 will bend relative to the support bracket 110, and thus assists in overcoming one of the problems with the previously known bridge plate locking assemblies. In this illustrated embodiment, the support block is a solid cube; however, it should be appreciated that the support block may be alternatively configured in accordance with the present disclosure. It should be appreciated that the support block could be made of other suitable materials (such as rubber) in accordance with the present disclosure.

In this illustrated embodiment, as best seen in FIGS. 3A, 3B, 4, 5, 8, and 9, the guide tube 140 includes an elongated hollow cylindrical body 141 that defines: (a) a central cylindrical lumen 142; (b) cylindrical openings 142*a* and 142*b* at opposite ends of the body 141; (c) a first or top roll pin cylindrical opening 143; (d) a second or bottom roll pin cylindrical opening 144; and (e) an oval elongated handle opening 146 extending part of the length of the side of the body 141. The central cylindrical lumen 142 and the cylindrical opening 142*a* are configured and sized such that the locking pin 160 is freely movable within the guide tube 140. The central cylindrical lumen 142 is also configured and sized such that the spring 190 is freely movable within the guide tube 140. The central cylindrical lumen 142 and the cylindrical opening 142*b* are configured and sized such that the fixed pivot pin 180 can be securely attached to the end of the body 141 that defines the opening 142*b*. The first or top roll pin cylindrical opening 143 and the second or bottom roll pin cylindrical opening 144 are aligned, configured, and sized such that the roll pin 168 can be inserted through either the top opening 143 or through the bottom opening 144 for attachment of the handle 170 to the locking pin 160, and such that the roll pin 168 can be pushed out of the top opening 143 or the bottom opening 144 for detachment of the handle 170 from the locking pin 160 as further described below. The handle opening 146 is configured and sized such that part of the handle 170 extends through the opening 146 and the guide tube 140 and is moveable in the opening 146. In this illustrated embodiment, the top of the guide tube 140 is connected (by welding) to the bottom of the support bracket 110, and particularly to the bottom surfaces of sections 111*a* and 111*e* of the support bracket 110, in two spaced apart locations. In this illustrated embodiment, the top of the guide tube 140 is connected (by welding) to the bottom of the support block 130. In this illustrated embodiment, the guide tube is cylindrical; however, it should be appreciated that that the guide tube may be alternatively configured in accordance with the present disclosure.

In this illustrated embodiment, as best seen in FIGS. 3A, 3B, 4, 5, and 10, the slidable locking pin 160 includes an elongated solid cylindrical body 161 with a chamfered first end 162*a* and a flat spring engagement opposite end 162*b*. The slidable locking pin 160 is configured to be partially positioned in the first end of the guide tube 140 and partially extend from the first end of the guide tube 140. The slidable locking pin 160 defines: (a) aligned cylindrical roll pin openings 163*a* and 163*b* extending through the top and bottom portions of the cylindrical body 161; and (b) a cylindrical handle receiving opening 164 transversely extending through the entire body 161 from one side of the body 161 to the opposite side of the body 161. The cylindrical roll pin openings 163*a* and 163*b* are configured and sized such that the roll pin 168 can be press fit into the openings 163*a* and 163*b* to securely but removably attach the handle 170 to the locking pin 160 as further described below. The cylindrical handle receiving opening 164 is configured and sized such that attachment end 172 of the handle 170 can be inserted into the locking pin 160. The elongated solid cylindrical body 161 has an end section that is configured to be removably inserted in a locking pin receiver (not shown) on an auto-rack car as is known in the industry to removably attach a bridge plate (not shown) to an auto-rack car. In this illustrated embodiment, the slidable locking pin is cylindrical and solid; however, it should be appreciated that that the slideable locking pin may be alternatively configured in accordance with the present disclosure.

In this illustrated embodiment, as best seen in FIGS. 3A, 4, 5, and 12, the handle 170 includes an elongated solid body having a cylindrical attachment section 172 and a cylindrical gripping section 174 integrally formed with the attachment section 172. The attachment section 172 of the handle 170 defines a cylindrical roll pin opening 173 extending through the entire body 171 from the top of the body 171 to the bottom of the body 171. The cylindrical roll pin opening 173 is configured and sized such that the roll pin 168 can be press fit into the opening 173 to securely, but removably, attach the handle 170 to the locking pin 160 as further described below. In this illustrated embodiment, the gripping section 174 of the handle 170 includes a rounded end 175. In this illustrated embodiment, the handle is a solid member; however, it should be appreciated that the handle may be alternatively configured and shaped in accordance with the present disclosure.

In this illustrated embodiment, as best seen in FIGS. 3A, 3B, 4, 5, and 11, the fixed pivot pin 180 includes an elongated solid body 181 having three integrally formed cylindrical sections including a first cylindrical section 182, an intermediate cylindrical section 183, and a third cylindrical section 184. The fixed pivot pin 180 is configured to be partially positioned in the second end of the guide tube 140 and to partially extend from the second end of the guide tube 140. More specifically, the first cylindrical section 182 is configured and specifically sized to be inserted in and fit in the second end of the guide tube 140 through opening 142*b*. The first section 182 defines a flat spring engagement end 182*a*. The third cylindrical section 184 includes a chamfered end 184*a* and is configured and specifically sized to extend from the end of the guide tube 140 and to be removably inserted in a pivot pin receiver (not shown) on an auto-rack car as is known in the industry to attach a bridge plate (not shown) to an auto-rack car. The intermediate cylindrical section 183 of the fixed pivot pin 180 has a greater circumference than the first cylindrical section 182 and the third cylindrical section 184, and is configured and specifically sized to be welded to the end of the guide tube 140 that forms the opening 142*b*. This provides a secure or fixed connection between the guide tube 140 and the fixed pivot pin 180. In this illustrated embodiment, the intermediate cylindrical section 183 of the fixed pivot pin 180 has a central cylindrical surface, a tapered outer surface, and a transverse flat inner surface. In this illustrated embodiment, the pivot pin is machined to specific tolerances to securely fit in the guide tube 140 and the pivot pin receiver (not shown) on an auto-rack car. In this illustrated embodiment, the pivot pin is generally solid and includes cylindrical sections; however, it should be appreciated that the pivot pin may be alternatively configured in accordance with the present disclosure. In this illustrated embodiment, the pivot pin is suitably welded to the guide tube 140, but could be otherwise suitably securely attached such that is does not move relative to the guide tube.

Figure 4:
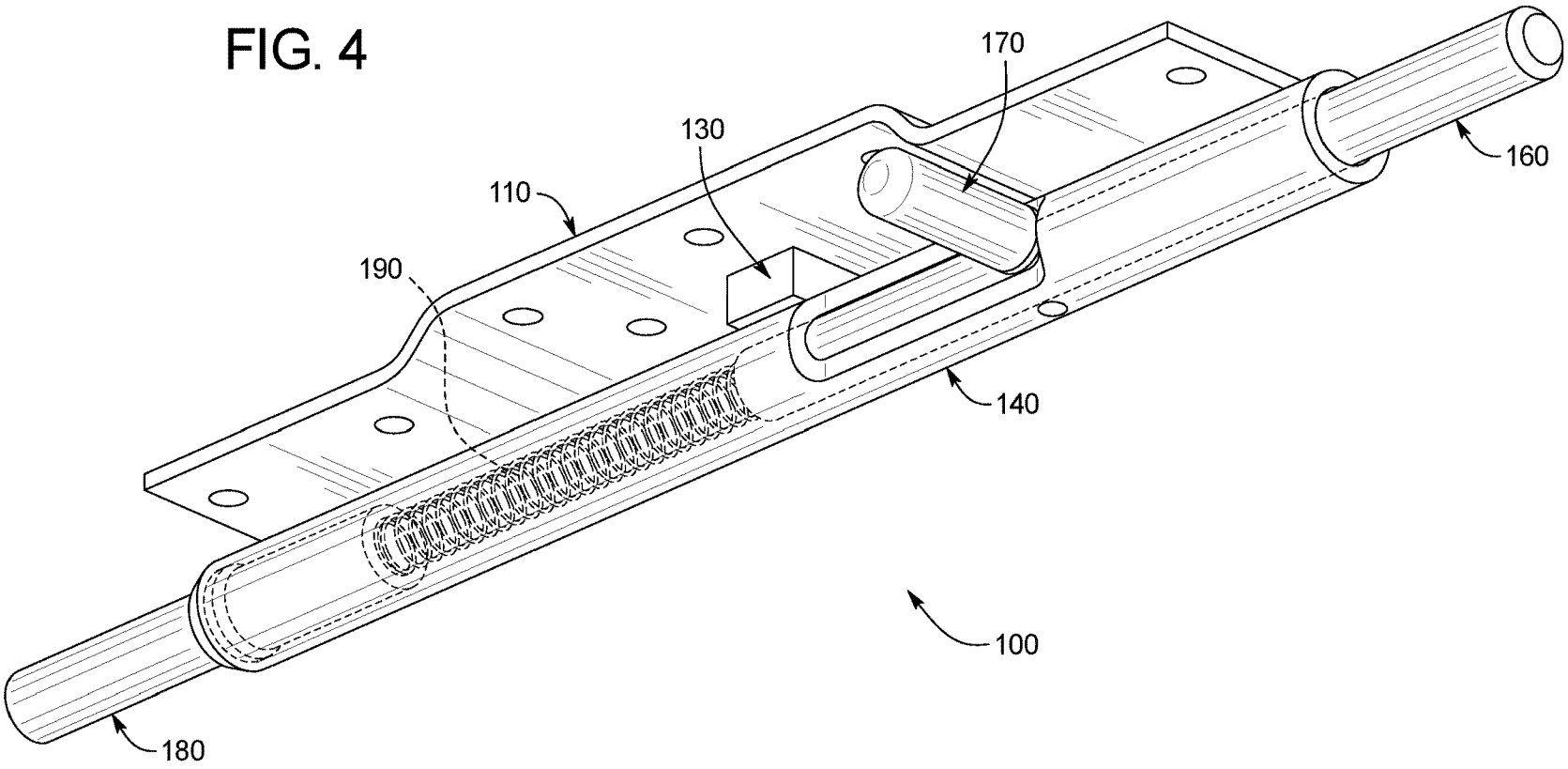
FIG. 4 is a bottom front perspective view of the auto-rack railroad car bridge plate locking assembly of FIGS. 3A and 3B, with the guide tube shown in phantom to illustrate the components in the guide tube.
Figure 5:
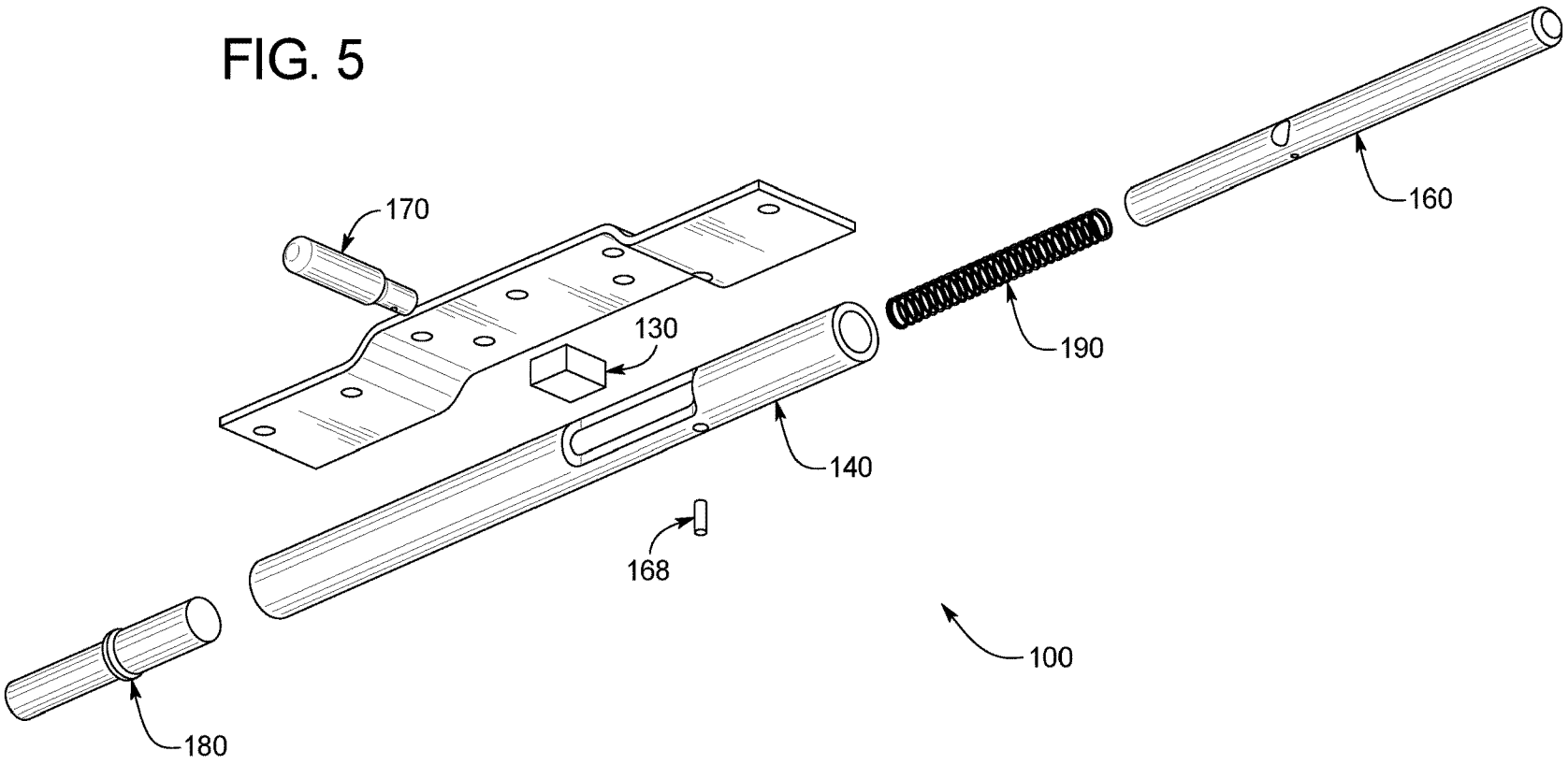
FIG. 5 is a bottom exploded perspective view of the auto-rack railroad car bridge plate locking assembly of FIGS. 3A and 3B.
Figure 6:
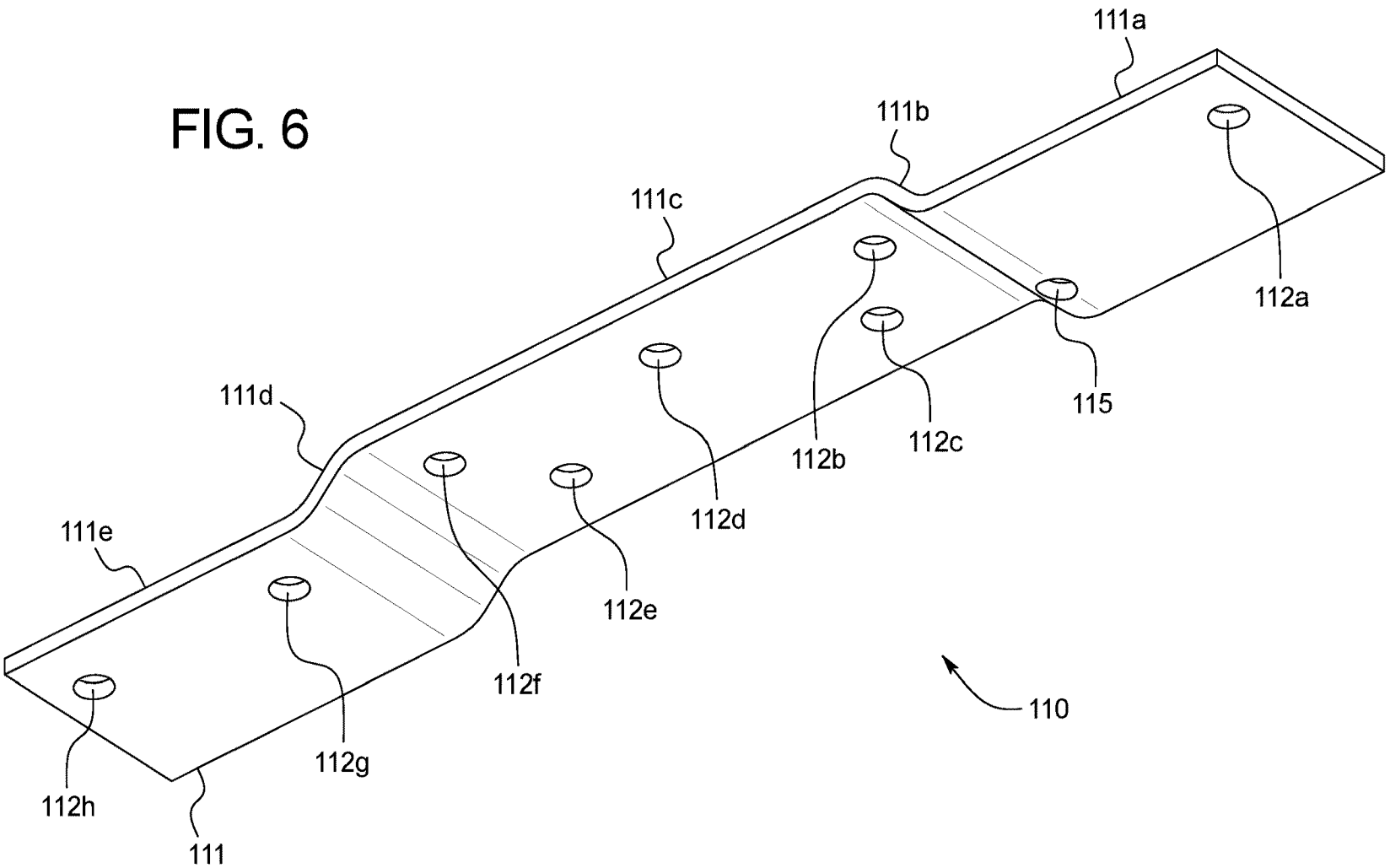
FIG. 6 is an enlarged bottom front perspective view of the support bracket of the auto-rack railroad car bridge plate locking assembly of FIGS. 3A and 3B.
Figure 7:
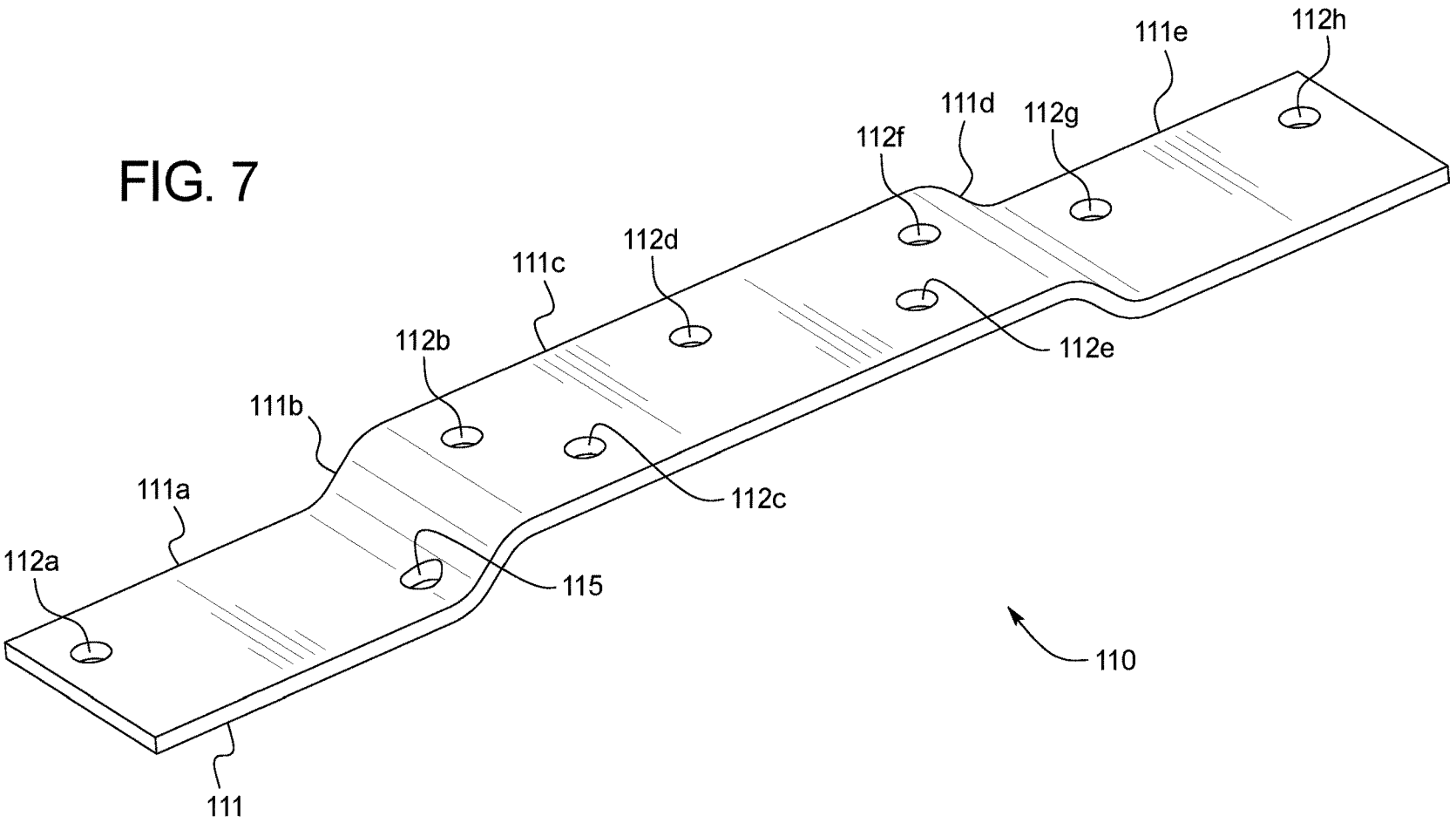
FIG. 7 is an enlarged top rear perspective view of the support bracket of the auto-rack railroad car bridge plate locking assembly of FIGS. 3A and 3B.
Figure 8:
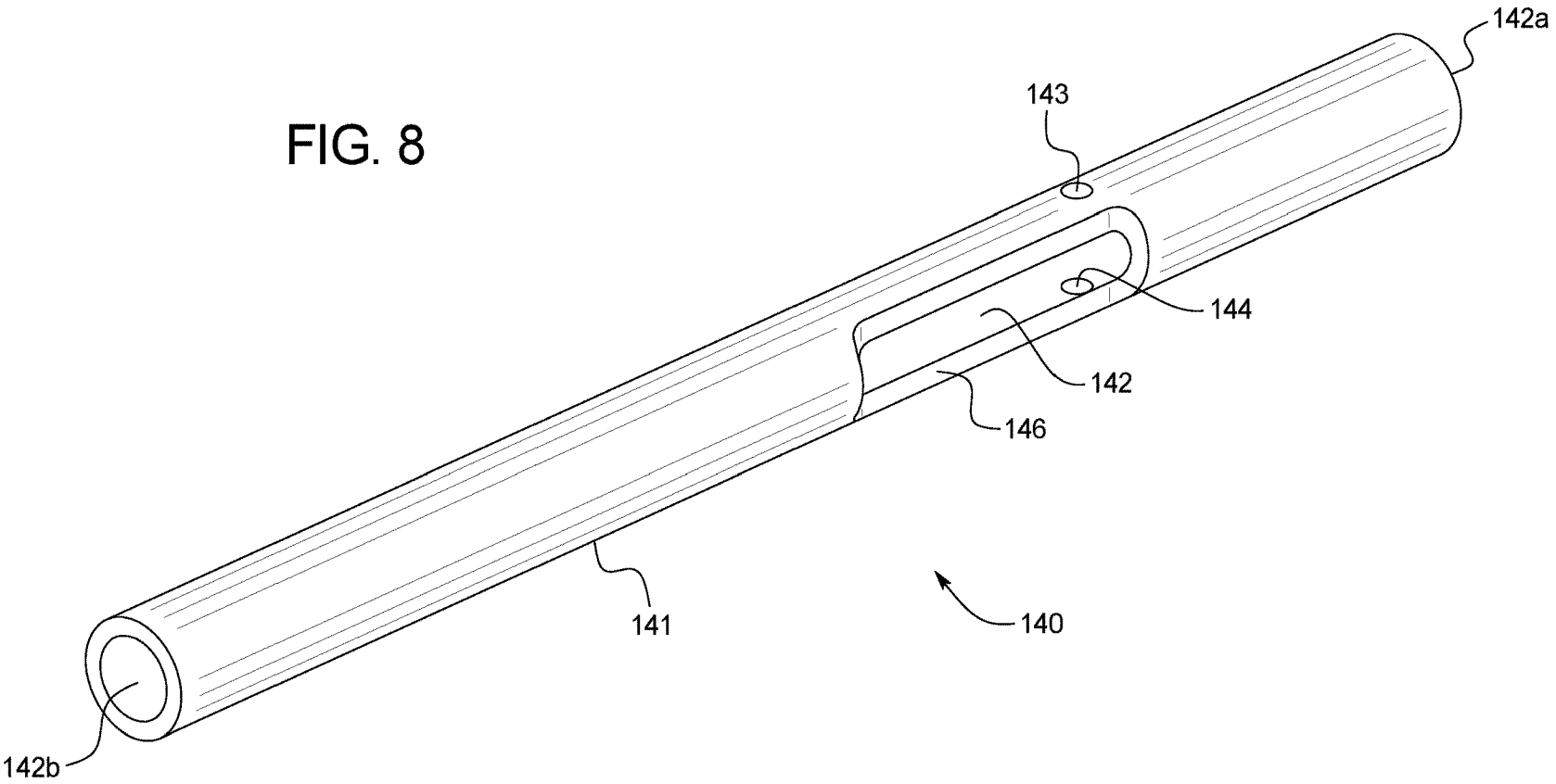
FIG. 8 is an enlarged top front perspective view of the guide tube of the auto-rack railroad car bridge plate locking assembly of FIGS. 3A and 3B.
Figure 9:
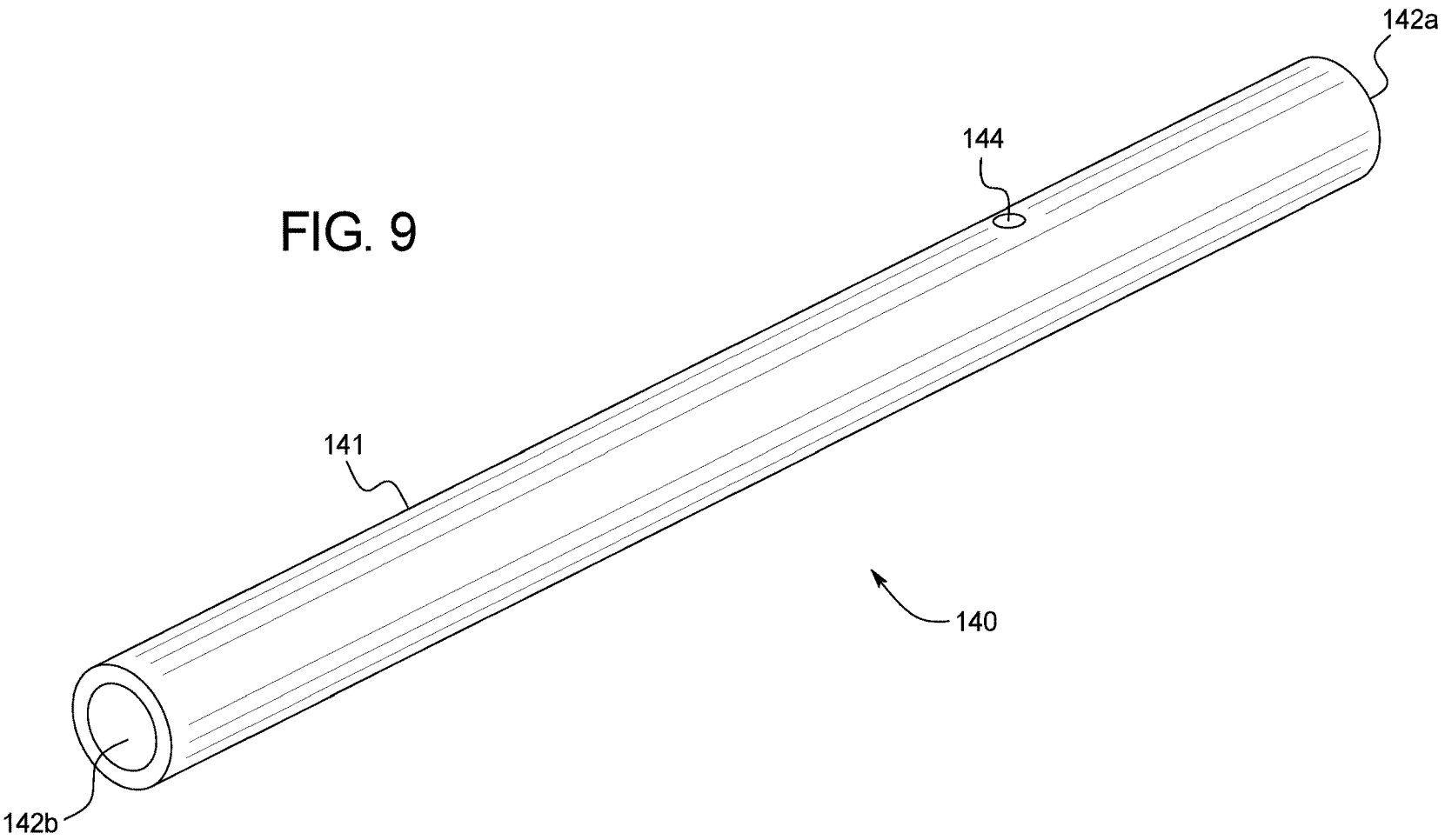
FIG. 9 is an enlarged top rear perspective view of the guide tube of the auto-rack railroad car bridge plate locking assembly of FIGS. 3A and 3B.
Figure 10:
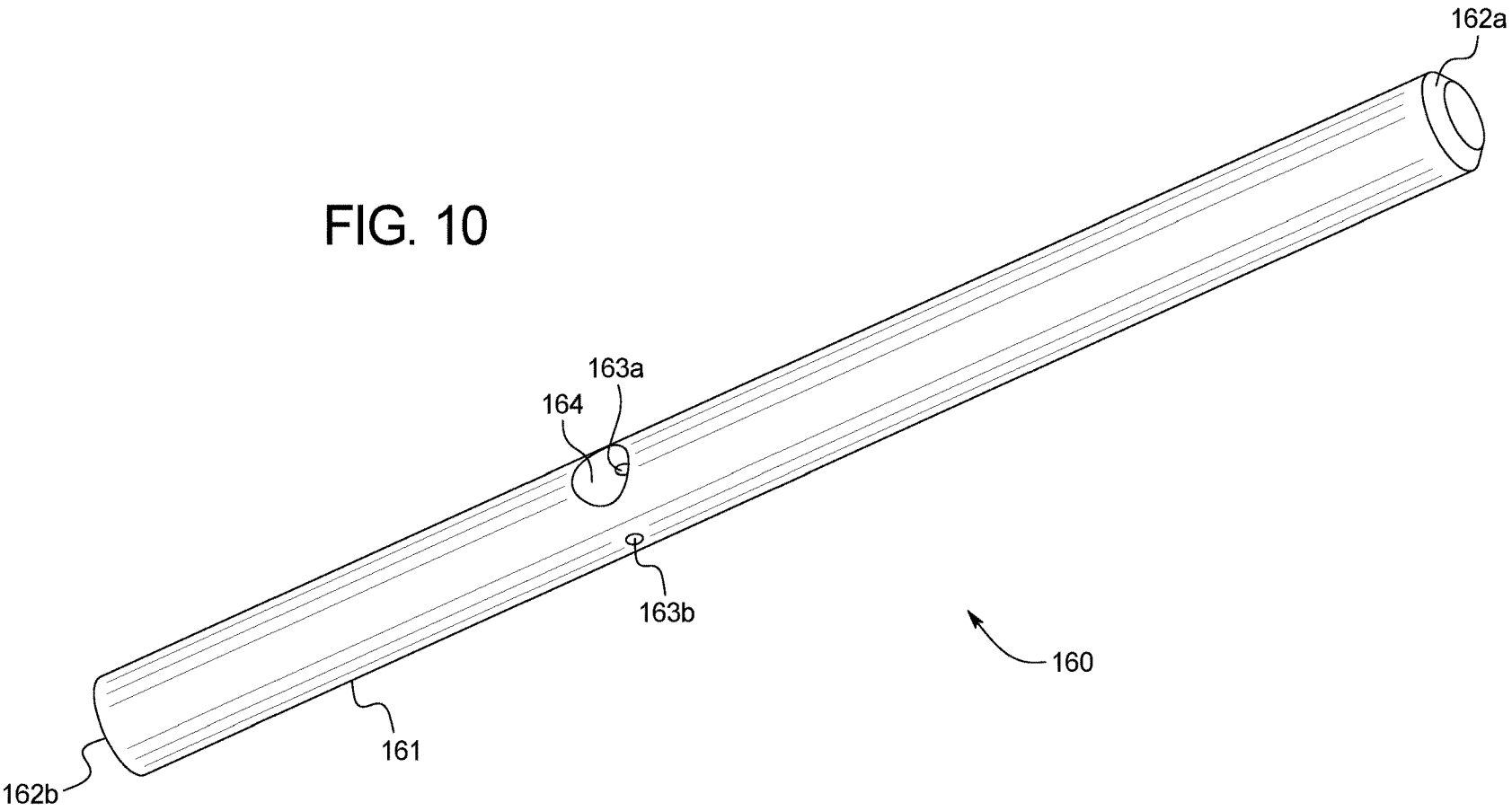
FIG. 10 is an enlarged bottom front perspective view of the locking pin of the auto-rack railroad car bridge plate locking assembly of FIGS. 3A and 3B.
Figure 11:
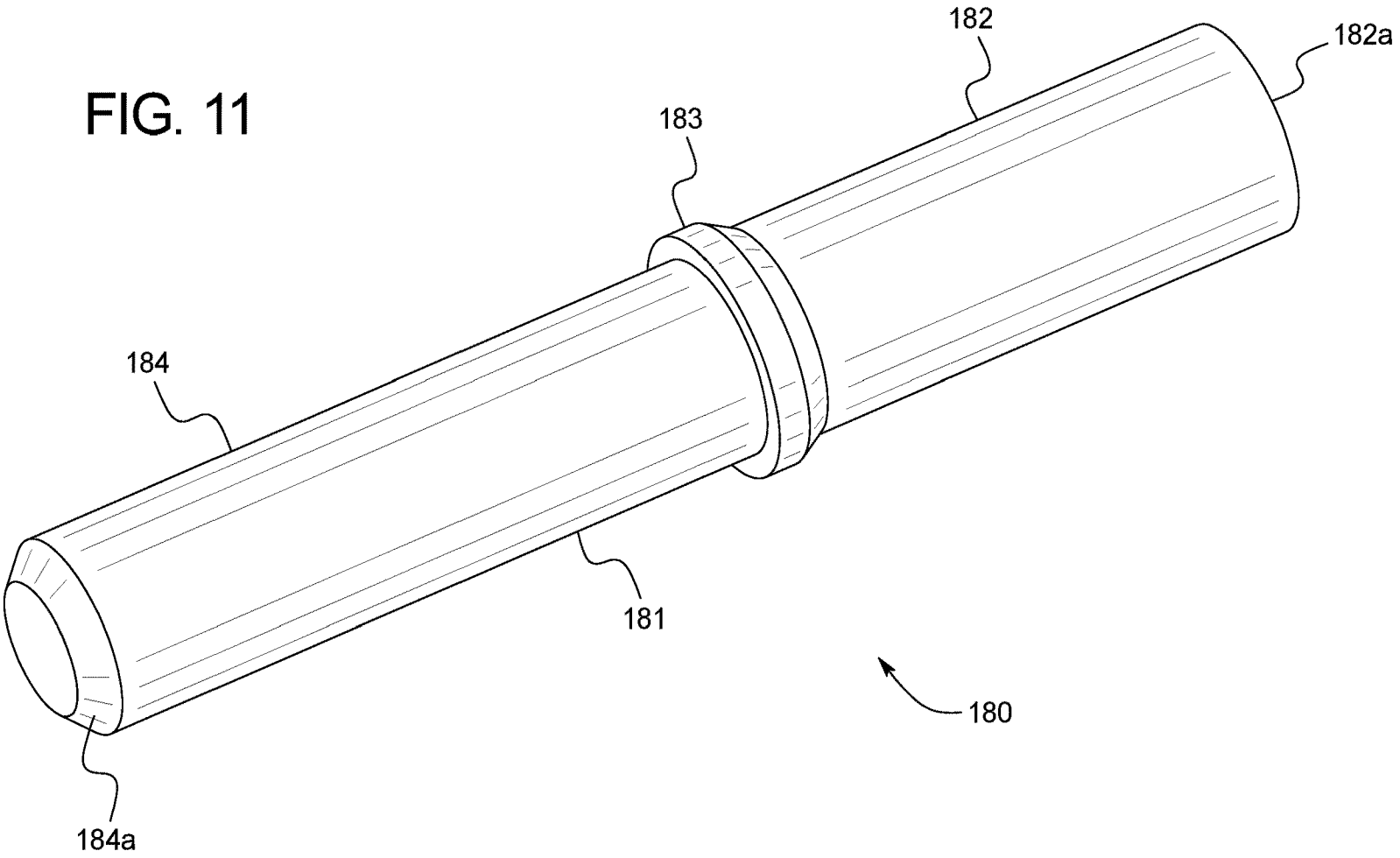
FIG. 11 is an enlarged bottom perspective view of the fixed pivot pin of the auto-rack railroad car bridge plate locking assembly of FIGS. 3A and 3B.
Figure 12:
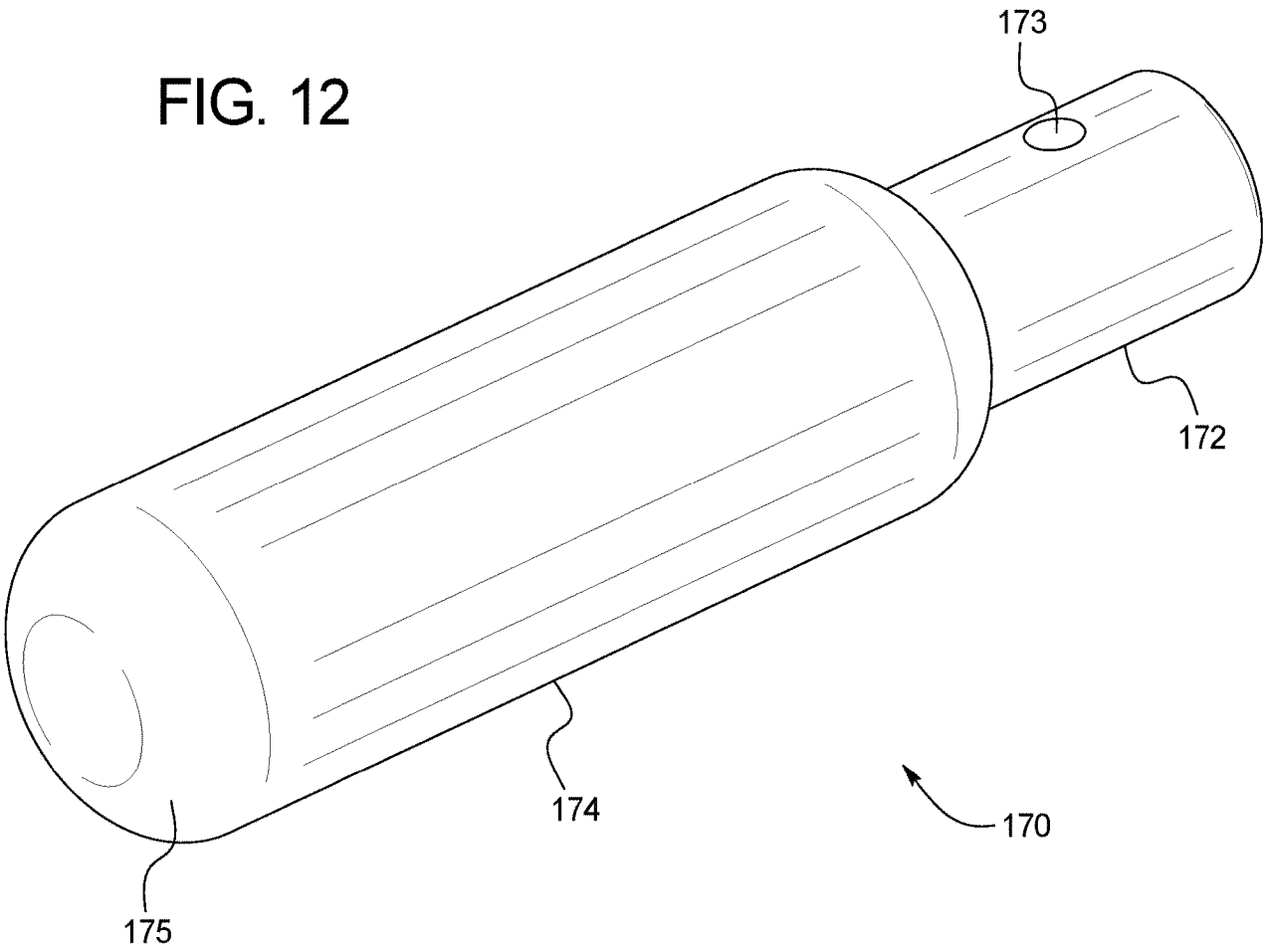
FIG. 12 is an enlarged top perspective view of the handle of the auto-rack railroad car bridge plate locking assembly of FIGS. 3A and 3B.

In this illustrated embodiment, as best seen in FIGS. 4 and 5, the spring 190 is a coil spring configured and sized to be positioned in the guide tube 40 between the fixed pivot pin 180 and the locking pin 160. The spring 190 has a first end configured to engage or butt up against the flat spring engagement opposite end 162*b* of the slidable locking pin 160 and an opposite second end configured to engage or butt up against the flat spring engagement end 182*a* of the first section 182 of the fixed pivot pin 180. The spring 190 is configured and sized to apply a biasing force against the locking pin 160 to push the locking pin 160 outwardly from the first end of the guide tube 140. In this illustrated embodiment, the spring is cylindrical; however, it should be appreciated that the spring may be alternatively configured in accordance with the present disclosure.

In this illustrated embodiment, to assemble the bridge plate locking assembly 100: (a) the support block 130 is welded to the bottom of the third section 111*c* of the support bracket 110; (b) the guide tube 140 is welded to the bottom of the first section 111*a* of the support bracket 110, to the bottom of the fifth section 111*c* of the support bracket 110, and to the bottom of the support block 130; (c) the first section 182 of the fixed pivot pin 180 is inserted into the second end of the guide tube 140 and the intermediate section 183 is welded to that second end of the guide tube 140; (d) the spring 190 is inserted into the guide tube 140 through the first end of the guide tube 140; (e) the locking pin 160 is inserted into the first end of the guide tube 140 such that the pin removal opening 115, the first roll pin cylindrical opening 143, the second roll pin cylindrical opening 144, and the roll pin openings 163*a* and 163*b* are aligned; (f) the attachment section 172 of the handle 170 is inserted through the handle opening 146 in the guide tube 140 and into the handle receiving opening 164 of locking pin 160 such that roll pin opening 173 defined by the handle 170 is also aligned with the pin removal opening 115, the first roll pin cylindrical opening 143, the second roll pin cylindrical opening 144, and the roll pin openings 163*a* and 163*b*; and (g) the roll pin 168 is inserted through the opening 143 and press fit into the roll pin openings 163*a* and 163*b* and the roll pin opening 173 defined by the handle 170 to securely attach the handle 170 to the locking pin 160. It should be appreciated that the order of assembly may vary in accordance with the present disclosure.

If the locking pin 160 is bent or damaged in use or otherwise, the locking pin 160 can be replaced. In this illustrated embodiment, to replace the locking pin 160, the roll pin 168 is pushed out from being in the roll pin openings 163*a* and 163*b* and the roll pin opening 173 through the first roll pin cylindrical opening 143 in the guide tube 140 and through the pin removal opening 115 in the support bracket 110. Alternatively, in this illustrated embodiment, to replace the locking pin 160, the roll pin 168 is pushed out from being in the roll pin openings 163*a* and 163*b* and the roll pin opening 173 through the second roll pin cylindrical opening 144 in the guide tube 140. In either case, a suitable tool such as punch (not shown) can be inserted in the respective openings to engage and push out the roll pin 168. The pin removal opening 115 in the support bracket 110 facilitates the insertion of such a tool and the removal of the roll pin 168 in either of these above described removal directions. After the roll pin 168 is removed, the handle 170 can then be removed from the locking pin 160, and the locking pin 160 can be removed from the guide tube 140. A new locking pin 160 can then be inserted into the guide tube 140 such that the pin removal opening 115, the first roll pin cylindrical opening 143, the second roll pin cylindrical opening 144, and the roll pin openings 163*a* and 163*b* are aligned. The attachment section 172 of the handle 170 can be inserted into the handle receiving opening 164 of locking pin 160 such that the roll pin opening 173 defined by the handle 170 is aligned with pin removal opening 115, the first roll pin cylindrical opening 143, the second roll pin cylindrical opening 144, and the roll pin openings 163*a* and 163*b*. The roll pin 168 can be inserted through the opening 143 and press fit into roll pin opening 163 and roll pin opening 173 defined by the handle 170 to secure the handle 170 to the new locking pin 160. The handle and the roll pin can also be replaced in this manner.

It should thus be appreciated that the removable handle and the locking pin enable the locking pin to be replaced if the locking pin is bent during use, installation, or removal. The combination of these components enables the locking assembly to be readily and efficiently repaired without the need to replace the entire locking assembly or entire bridge plate.

It should also be appreciated from the above that that the auto-rack railroad car bridge plate locking assembly of the present disclosure eliminates the need for a collar (described above), and thus in various embodiments does not include such a collar.

It should also be appreciated from the above that that the auto-rack railroad car bridge plate locking assembly of the present disclosure provides a pivot pin that is securely attached to the guide tube, eliminates the need for a loosely attached pivot pin (described above), and thus in various embodiments does not include such a loosely attached pivot pin.

It should be appreciated from the above that in certain embodiments, the present disclosure provides an auto-rack railroad car bridge plate locking assembly including: (a) a support bracket; (b) a guide tube connected to the support bracket; (c) a support block positioned between the support bracket and the guide tube, said support block connected to the support bracket and to the guide tube; (d) a slidable locking pin partially positioned in the guide tube; (e) a handle removably attached to the locking pin by a removable roll pin; (f) a pivot pin partially positioned in and connected to the guide tube; and (g) a spring positioned in the guide tube between the pivot pin and the locking pin and configured to apply a biasing force against the locking pin to push the locking pin outwardly from the guide tube.

It should further be appreciated from the above that in certain such embodiments, the present disclosure provides such an auto-rack railroad car bridge plate locking assembly wherein: (i) the support bracket includes a first section, a second section, a third section, a fourth section, and a fifth section, the second section defining a pin removal opening that enables the roll pin to be removed from the locking pin and the handle; (ii) the support block is positioned between the third section of the support bracket and the guide tube; (iii) the guide tube defines a central cylindrical lumen, cylindrical openings at opposite ends, a first cylindrical roll pin opening, a second cylindrical roll pin opening, and an elongated handle opening; (iv) the slidable locking pin defines aligned cylindrical roll pin openings and a cylindrical handle receiving opening; (v) the handle includes an attachment section and a gripping section, the attachment section defining a cylindrical roll pin opening; and (vi) the pivot pin includes a cylindrical body having a first section, an intermediate section, and a second section.

Various embodiments of the present disclosure also provide an auto-rack railroad car bridge plate with the locking assembly described above.

It should thus be further appreciated from the above that in certain embodiments, the present disclosure provides an auto-rack railroad car bridge plate including: a plate configured to extend from one auto-rack railroad car to an adjacent auto-rack railroad car; and a locking assembly connected to the plate and configured to pivotally attach the plate to one of the auto-rack rail road cars, wherein the locking assembly includes: (a) a support bracket; (b) a guide tube connected to the support bracket; (c) a support block positioned between the support bracket and the guide tube, said support block connected to the support bracket and to the guide tube; (d) a slidable locking pin partially positioned in the guide tube; (e) a handle removably attached to the locking pin by a removable roll pin; (f) a pivot pin partially positioned in and connected to the guide tube; and (g) a spring positioned in the guide tube between the pivot pin and the locking pin and configured to apply a biasing force against the locking pin to push the locking pin outwardly from the guide tube.

It should further be appreciated from the above that in certain such embodiments the present disclosure provides such an auto-rack railroad car bridge plate wherein: (i) the support bracket includes a first section a second section, a third section, a fourth section, and a fifth section, the second section defining a pin removal opening that enables the roll pin to be removed from the locking pin and the handle; (ii) the support block is positioned between the third section of the support bracket and the guide tube; (iii) the guide tube defines a central cylindrical lumen, cylindrical openings at opposite ends, a first cylindrical roll pin opening, a second cylindrical roll pin opening, and an elongated handle opening; (iv) the slidable locking pin defines aligned cylindrical roll pin openings and a cylindrical handle receiving opening; (v) the handle includes an attachment section and a gripping section, the attachment section defining a cylindrical roll pin opening; and (vi) the pivot pin includes a cylindrical body having a first section, an intermediate section, and a second section.

It should be understood that modifications and variations may be effected without departing from the scope of the novel concepts of the present invention, and it should be understood that this application is to be limited only by the scope of the claims.

The invention is claimed as follows:

1. An auto-rack railroad car bridge plate locking assembly comprising:

(a) a support bracket defining a pin removal opening;

(b) a guide tube connected to the support bracket, the guide tube defining a first roll pin opening and a second roll pin opening;

(c) a slidable locking pin partially positioned in the guide tube, the slidable locking pin defining aligned openings and a handle receiving opening;

(d) a handle removably attached to the locking pin by a removable roll pin, the handle defining a roll pin opening;

(e) a pivot pin partially positioned in and connected to the guide tube; and (f) a spring positioned in the guide tube between the pivot pin and the locking pin, said spring configured to apply a biasing force against the locking pin to push the locking pin in an outward direction from the guide tube.

2. The auto-rack railroad car bridge plate locking assembly of claim 1, wherein:

(i) the support bracket includes a first section, a second section, a third section, a fourth section, and a fifth section, the second section defining the pin removal opening that enables the roll pin to be removed from the locking pin and the handle;

(ii) the guide tube defines a central cylindrical lumen, cylindrical openings at opposite ends, the first roll pin opening being cylindrical, the second roll pin opening being cylindrical, and an elongated handle opening;

(iii) the slidable locking pin defines the aligned roll pin openings being cylindrical and the handle receiving opening being cylindrical;

(iv) the handle includes an attachment section and a gripping section, the attachment section defining the roll pin opening being cylindrical; and (v) the pivot pin includes a body having a first cylindrical section, an intermediate cylindrical section, and a second cylindrical section.

3. The auto-rack railroad car bridge plate locking assembly of claim 2, wherein the guide tube is cylindrical, the slidable locking pin is cylindrical, the pivot pin is cylindrical, and the spring is cylindrical.

4. The auto-rack railroad car bridge plate locking assembly of claim 2, which includes a support block positioned between the support bracket and the guide tube.

5. The auto-rack railroad car bridge plate locking assembly of claim 4, wherein said support block is connected to the support bracket and to the guide tube.

6. The auto-rack railroad car bridge plate locking assembly of claim 5, wherein the support block is welded to the support bracket and to the guide tube.

7. The auto-rack railroad car bridge plate locking assembly of claim 4, wherein the support block is positioned between the third section of the support bracket and the guide tube.

8. The auto-rack railroad car bridge plate locking assembly of claim 1, which includes a support block positioned between the support bracket and the guide tube.

9. The auto-rack railroad car bridge plate locking assembly of claim 8, wherein the support block is connected to the support bracket and to the guide tube.

10. The auto-rack railroad car bridge plate locking assembly of claim 9, wherein the support block is welded to the support bracket and to the guide tube.

11. The auto-rack railroad car bridge plate locking assembly of claim 1, wherein the support bracket includes a first section, a second section, a third section, a fourth section, and a fifth section, the second section defining the pin removal opening that enables the roll pin to be removed from the locking pin and the handle.

12. The auto-rack railroad car bridge plate locking assembly of claim 1, wherein: (a) the guide tube defines a central cylindrical lumen, cylindrical openings at opposite ends, the first roll pin opening being cylindrical, the second roll pin opening being cylindrical, and an elongated handle opening; and (b) the slidable locking pin defines the aligned roll pin openings being cylindrical and the handle receiving opening being cylindrical.

13. The auto-rack railroad car bridge plate locking assembly of claim 1, wherein the handle includes an attachment section and a gripping section, and wherein the attachment section defines the roll pin opening being cylindrical.

14. The auto-rack railroad car bridge plate locking assembly of claim 1, wherein the pivot pin includes a body having a first cylindrical section, an intermediate cylindrical section, and a second cylindrical section.

15. The auto-rack railroad car bridge plate locking assembly of claim 1, wherein the support bracket, the guide tube, the locking pin, the handle, the roll pin, the pivot pin, and the spring are all made of steel.

16. An auto-rack railroad car bridge plate comprising:

a plate configured to extend from one auto-rack railroad car to an adjacent auto-rack railroad car; and a locking assembly connected to the plate and configured to pivotally attach the plate to one of the auto-rack rail road cars, said locking assembly including:

(a) a support bracket defining a pin removal opening;

(b) a guide tube connected to the support bracket, the guide tube defining a first roll pin opening and a second roll pin opening;

(c) a slidable locking pin partially positioned in the guide tube, the slidable locking pin defining aligned openings and a handle receiving opening;

(d) a handle removably attached to the locking pin by a removable roll pin, the handle defining a roll pin opening;

(e) a pivot pin partially positioned in and connected to the guide tube; and (f) a spring positioned in the guide tube between the pivot pin and the locking pin, said spring configured to apply a biasing force against the locking pin to push the locking pin in an outward direction from the guide tube.

17. The auto-rack railroad car bridge plate of claim 16, wherein:

(i) the support bracket includes a first section, a second section, a third section, a fourth section, and a fifth section, the second section defining the pin removal opening that enables the roll pin to be removed from the locking pin and the handle;

(ii) the guide tube defines a central cylindrical lumen, cylindrical openings at opposite ends, the first roll pin opening being cylindrical, the second roll pin opening being cylindrical, and an elongated handle opening;

(iii) the slidable locking pin defining the aligned roll pin openings being cylindrical and the handle receiving opening being cylindrical;

(iv) the handle includes an attachment section and a gripping section, the attachment section defining the roll pin opening being cylindrical; and (v) the pivot pin includes a body having a first cylindrical section, an intermediate cylindrical section, and a second cylindrical section.

18. The auto-rack railroad car bridge plate of claim 17, wherein the guide tube is cylindrical, the slidable locking pin is cylindrical, the pivot pin is cylindrical, and the spring is cylindrical.

19. The auto-rack railroad car bridge plate of claim 17, which includes a support block positioned between the support bracket and the guide tube.

20. The auto-rack railroad car bridge plate of claim 19, wherein said support block is connected to the support bracket and to the guide tube.

21. The auto-rack railroad car bridge plate of claim 20, wherein the support block is welded to the support bracket and to the guide tube.

22. The auto-rack railroad car bridge plate of claim 19, wherein the support block is positioned between the third section of the support bracket and the guide tube.

23. The auto-rack railroad car bridge plate of claim 16, which includes a support block positioned between the support bracket and the guide tube.

24. The auto-rack railroad car bridge plate of claim 23, wherein the support block is connected to the support bracket and to the guide tube.

25. The auto-rack railroad car bridge plate of claim 24, wherein the support block is welded to the support bracket and to the guide tube.

26. The auto-rack railroad car bridge plate of claim 16, wherein the support bracket includes a first section, a second section, a third section, a fourth section, and a fifth section, the second section defining the pin removal opening that enables the roll pin to be removed from the locking pin and the handle.

27. The auto-rack railroad car bridge plate of claim 16, wherein: (a) the guide tube defines a central cylindrical lumen, cylindrical openings at opposite ends, the first roll pin opening being cylindrical, the second cylindrical roll pin opening being cylindrical, and an elongated handle opening; and (b) the slidable locking pin defines the aligned roll pin openings being cylindrical and the handle receiving opening being cylindrical.

28. The auto-rack railroad car bridge plate of claim 16, wherein the handle includes an attachment section and a gripping section, and wherein the attachment section defines the roll pin opening being cylindrical.

29. The auto-rack railroad car bridge plate of claim 16, wherein the pivot pin includes a body having a first cylindrical section, an intermediate cylindrical section, and a second cylindrical section.

30. The auto-rack railroad car bridge plate of claim 16, wherein the support bracket, the guide tube, the locking pin, the handle, the roll pin, the pivot pin, and the spring are all made of steel.

31. An auto-rack railroad car bridge plate locking assembly comprising:

(a) a support bracket;

(b) a guide tube connected to the support bracket, the guide tube defining a slotted opening;

(c) a slidable locking pin partially positioned in the guide tube, the slidable locking pin defining a handle receiving opening;

(d) a removable cylindrical handle attachment member;

(e) a handle removably attached to the locking pin by the removable cylindrical handle attachment member, the handle including an inner wall that defines an opening into which the removable cylindrical handle attachment member extends such that said removable cylindrical handle attachment member engages said inner wall and such that the removable cylindrical handle attachment member secures the handle to the locking pin;

(f) a pivot pin partially positioned in and connected to the guide tube; and (g) a spring positioned in the guide tube between the pivot pin and the locking pin, said spring configured to apply a biasing force against the locking pin to push the locking pin in an outward direction from the guide tube.

32. The auto-rack railroad car bridge plate locking assembly of claim 31, wherein the support bracket, the guide tube, the locking pin, the handle, the a removable cylindrical handle attachment member, the pivot pin, and the spring are all made of steel.

33. An auto-rack railroad car bridge plate comprising:

a plate configured to extend from one auto-rack railroad car to an adjacent auto-rack railroad car; and a locking assembly connected to the plate and configured to pivotally attach the plate to one of the auto-rack rail road cars, said locking assembly including:

(a) a support bracket;

(b) a guide tube connected to the support bracket, the guide tube defining a slotted opening;

(c) a slidable locking pin partially positioned in the guide tube, the slidable locking pin defining a handle receiving opening;

(d) a removable cylindrical handle attachment member;

(e) a handle removably attached to the locking pin by the removable cylindrical handle attachment member, the handle including an inner wall that defines an opening into which the removable cylindrical handle attachment member extends such that said removable cylindrical handle attachment member engages said inner wall and such that the removable cylindrical handle attachment member secures the handle to the locking pin;

(f) a pivot pin partially positioned in and connected to the guide tube; and (g) a spring positioned in the guide tube between the pivot pin and the locking pin, said spring configured to apply a biasing force against the locking pin to push the locking pin in an outward direction from the guide tube.

34. The auto-rack railroad car bridge plate of claim 33, wherein the support bracket, the guide tube, the locking pin, the handle, the a removable cylindrical handle attachment member, the pivot pin, and the spring are all made of steel.

* * * * *